US011397022B2

(12) United States Patent
Nakamura et al.

(10) Patent No.: US 11,397,022 B2
(45) Date of Patent: Jul. 26, 2022

(54) AIR CONDITIONER

(71) Applicant: Mitsubishi Electric Corporation, Tokyo (JP)

(72) Inventors: Taro Nakamura, Tokyo (JP); Yohei Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 301 days.

(21) Appl. No.: 16/491,048

(22) PCT Filed: May 22, 2017

(86) PCT No.: PCT/JP2017/019091
§ 371 (c)(1),
(2) Date: Sep. 4, 2019

(87) PCT Pub. No.: WO2018/216085
PCT Pub. Date: Nov. 29, 2018

(65) Prior Publication Data

US 2020/0072489 A1 Mar. 5, 2020

(51) Int. Cl.
*F24F 1/0047* (2019.01)
*F24F 11/89* (2018.01)
(Continued)

(52) U.S. Cl.
CPC ..... *F24F 11/89* (2018.01); *F24F 1/0047* (2019.02); *F24F 13/20* (2013.01); *F24F 13/32* (2013.01); *F24F 2013/205* (2013.01)

(58) Field of Classification Search
CPC ..... F24F 11/89; F24F 1/0047; F24F 13/20; F24F 13/32; F24F 2013/205
(Continued)

(56) References Cited

U.S. PATENT DOCUMENTS

2012/0328420 A1 12/2012 Ikeda et al.
2017/0045259 A1 2/2017 Choi et al.

FOREIGN PATENT DOCUMENTS

CN 205452798 U 8/2016
CN 106468459 A 3/2017
(Continued)

OTHER PUBLICATIONS

Linyan, Liu; CN205452798 Translation.pdf, "A combination section bar for switch board", Oct. 2016, pp. 1-5.*
(Continued)

*Primary Examiner* — Avinash A Savani
*Assistant Examiner* — Ryan L Faulkner
(74) *Attorney, Agent, or Firm* — Posz Law Group, PLC

(57) ABSTRACT

An air conditioner including an electrical-component box to accommodate therein electrical components on a lower surface of the air conditioner in an installation state in which the air conditioner is installed in a ceiling, wherein the electrical-component box includes an electrical-component box body having a box shape with a lower surface opened in the installation state, and including a body-side engaging portion protruding outward from a side surface, and a plate-like lid capable of closing the opening and including a lid-side engaging portion to be engaged with the body-side engaging portion, and wherein the lid is capable of being suspended from the electrical-component box body by engaging the lid-side engaging portion with the body-side engaging portion, and the lid includes a temporary item-placement portion on which items can be temporarily placed in a suspended state in which the lid is suspended from the electrical-component box body.

3 Claims, 5 Drawing Sheets

(51) Int. Cl.
*F24F 13/20* (2006.01)
*F24F 13/32* (2006.01)

(58) Field of Classification Search
USPC ..... 454/254
See application file for complete search history.

(56) References Cited

FOREIGN PATENT DOCUMENTS

| | | | |
|---|---|---|---|
| EP | 3 130 864 | A1 | 2/2017 |
| JP | H09-060917 | A | 3/1997 |
| JP | H11-094294 | A | 4/1999 |
| JP | 2010-002076 | A | 1/2010 |
| JP | 2011-208859 | A | 10/2011 |
| JP | 2015-031480 | A | 2/2015 |
| WO | 2011/121943 | A1 | 10/2011 |
| WO | 2017/002237 | A1 | 1/2017 |

OTHER PUBLICATIONS

Office Action dated Jun. 22, 2020 issued in corresponding AU patent application No. 2017415672.
Office Action dated Aug. 31, 2020 for the corresponding CN patent application No. 201780090042.0 (and English translation).
Chinese Office Action dated Mar. 12, 2021, issued in corresponding Chinese Patent Application No. 201780090042.0 (and English Machine Translation).
Office Action dated May 7, 2020 issued in corresponding JP patent application No. 2019-519826 (and English translation).
International Search Report of the International Searching Authority dated Jul. 4, 2017 in corresponding international application No. PCT/JP2017/019091 (and English translation).
Extended European Search Report dated May 14, 2019 issued in corresponding EP patent application No. 17890848.9.

* cited by examiner

AIR CONDITIONER

CROSS REFERENCE TO RELATED APPLICATION

This application is a U.S. national stage application of International Patent Application No. PCT/JP2017/019091 filed on May 22, 2017, the disclosure of which is incorporated herein by reference.

TECHNICAL FIELD

The present invention relates to a ceiling-mounted air conditioner provided with an electrical-component box.

BACKGROUND

In a ceiling-mounted air conditioner, an indoor device of the air conditioner is mounted in the ceiling. In general, during maintenance work on the ceiling-mounted air conditioner as described above, a worker stands on a stepstool such as a stepladder. Thus, it is often difficult for the worker to have somewhere to temporarily place the removed components.

In order to solve this problem, Patent Literature 1 discloses an air conditioner in which it is possible to suspend a lid of an electrical-component box from an electrical-component box body or an air conditioner body. Patent Literature 2 also discloses an air conditioner in which it is possible to suspend a lid from the electrical-component box body to temporarily hold the lid.

PATENT LITERATURE

Patent Literature 1: Japanese Patent Application Laid-open No. H11-94294

Patent Literature 2: Japanese Patent Application Laid-open No. 2011-208859

However, in the air conditioners in Patent Literatures 1 and 2 described above, in a case of performing maintenance work on electrical components in the electrical-component box, a worker needs to hold screws, having been removed to detach the lid, in his hand during the maintenance, or needs to temporarily place the removed screws somewhere else.

In the case where a worker performs the maintenance work with the screws held in his hand, the work efficiency is reduced because movement of some of his fingers is limited. It is conceivable to temporarily place the screws somewhere such as on the top of the stepladder, on the floor, in the pocket of the worker's uniform, and the like.

However, in a case of temporarily placing the screws on the top of the stepladder, there is a problem in that the worker needs to significantly change his posture in order to pick up the screws, which is inconvenient. Furthermore, in a case of temporarily placing the screws on the floor, there is a problem in that the worker needs to step off the stepladder, which is even more inconvenient. The worker often wears gloves during the maintenance work. Therefore, in a case of keeping the screws in the pocket of the worker's uniform, there is a problem that the worker may not easily take the screws out from the pocket.

SUMMARY

The present invention has been achieved to solve the above problems, and an object of the present invention is to provide an air conditioner that can facilitate maintenance on electrical components in an electrical-component box.

In order to solve the above-mentioned problems and achieve the object, the present invention provides an air conditioner including an electrical-component box to accommodate therein electrical components on a lower surface of the air conditioner in an installation state in which the air conditioner is installed in a ceiling. The electrical-component box includes an electrical-component box body having a box shape with a lower surface opened in the installation state, and including a body-side engaging portion protruding outward from a side surface, and a plate-like lid capable of closing the opening and including a lid-side engaging portion to be engaged with the body-side engaging portion. The lid is capable of being suspended from the electrical-component box body by engaging the lid-side engaging portion with the body-side engaging portion, and the lid includes a temporary item-placement portion on which items can be temporarily placed in a suspended state in which the lid is suspended from the electrical-component box body.

The ceiling-mounted air conditioner according to the present invention has an effect where it is possible to facilitate maintenance on electrical components in an electrical-component box.

DETAILED DESCRIPTION

An air conditioner according to embodiments of the present invention will be described in detail below with reference to the accompanying drawings. The present invention is not limited to the embodiments.

First Embodiment

Figure 1:
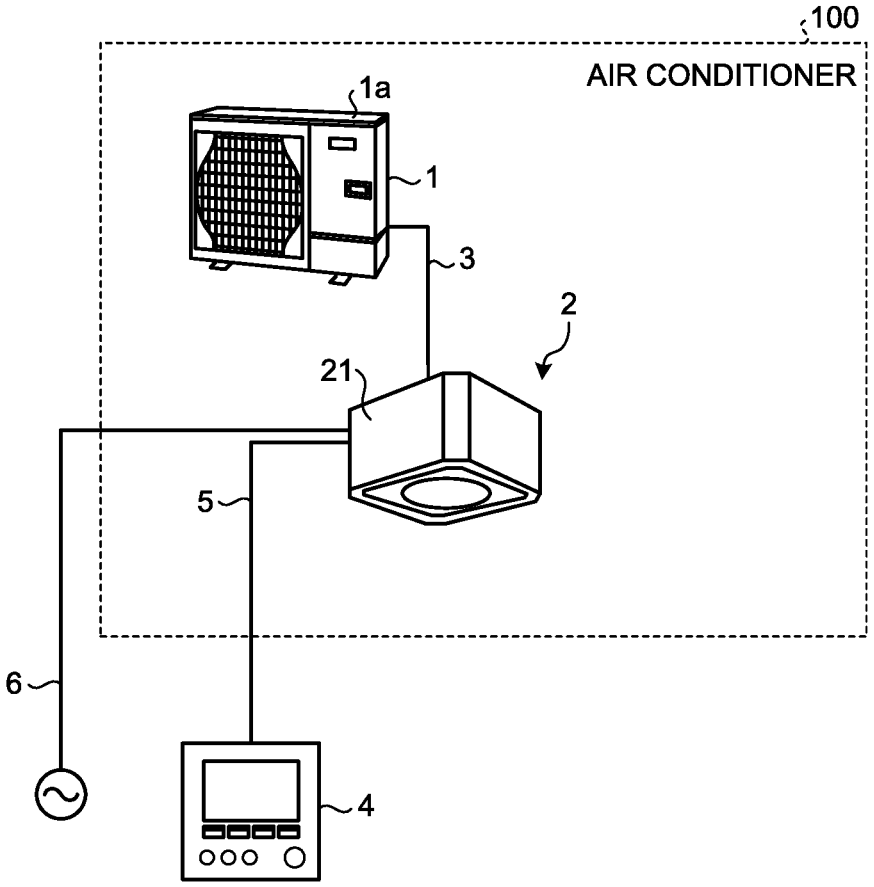
FIG. 1 is a diagram schematically illustrating an air conditioner according to a first embodiment of the present invention.

FIG. 1 is a diagram schematically illustrating an air conditioner 100 according to a first embodiment of the present invention. The air conditioner 100 includes a ceiling-mounted indoor device 2, an outdoor device 1 connected to the indoor device 2 through an indoor-outdoor line 3, a wired remote controller 4 connected to the indoor device 2 through a wired remote-control line 5 that is a signal line through which a signal is transmitted. The indoor-outdoor line 3 includes a signal line through which a signal is transmitted between the indoor device 2 and the outdoor device 1. Information to be transmitted and received between the wired remote controller 4 and the indoor device 2 is transmitted to the wired remote-control line 5.

The outdoor device 1 is provided with a cuboid-shaped outer panel 1*a* that is an outside casing of the outdoor device 1, a compressor, a heat exchanger, and a blower driven by a fan motor. FIG. 1 omits illustrations of the compressor, the heat exchanger, the fan motor, and the blower of the outdoor device 1.

Figure 2:
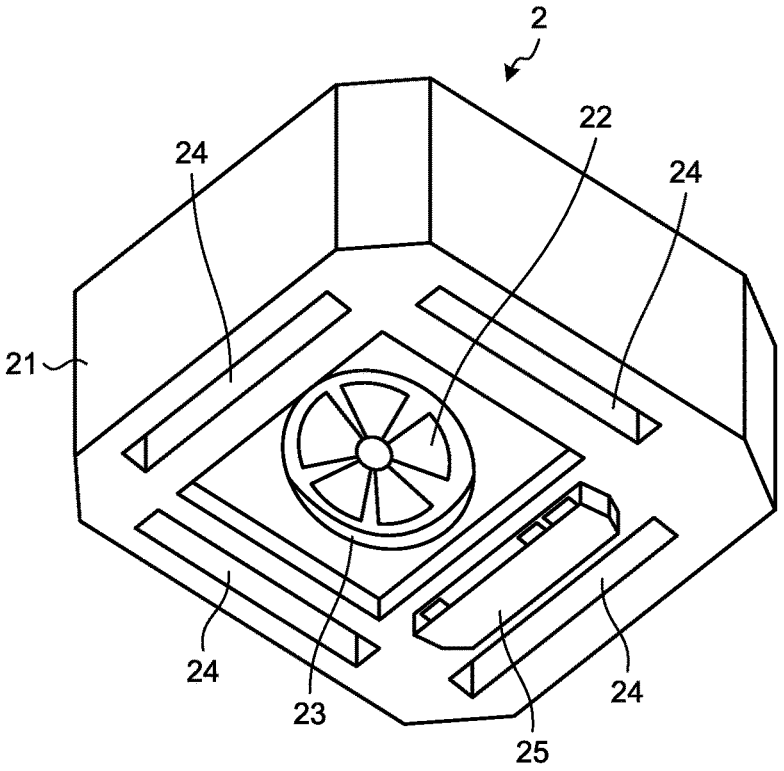
FIG. 2 is a perspective view of a casing of an indoor device with a lid of an electrical-component box closed, as viewed from a lower side of the casing in the air conditioner according to the first embodiment of the present invention.
Figure 3:
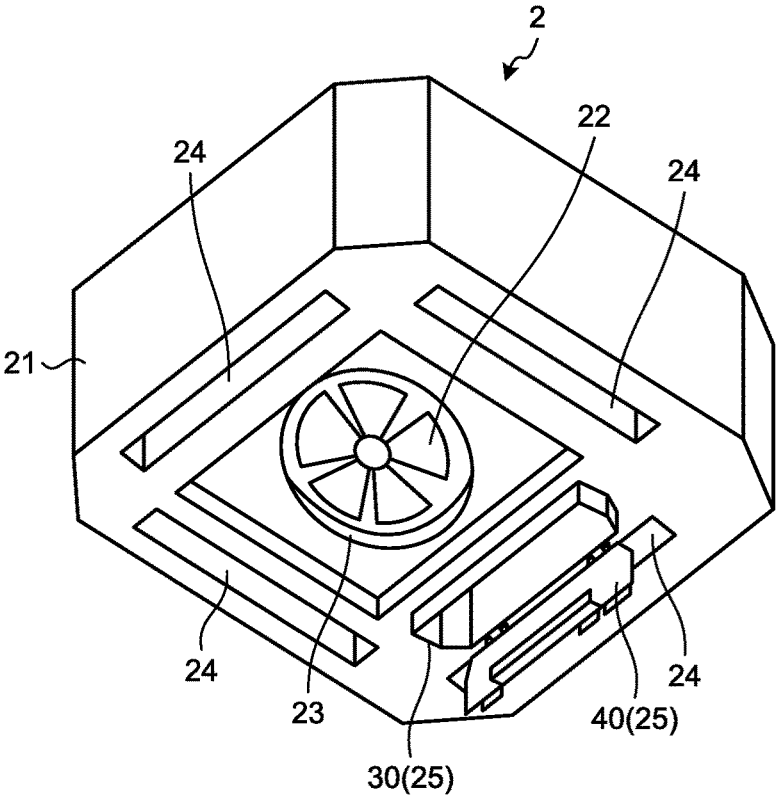
FIG. 3 is a perspective view of the casing of the indoor device with the lid of the electrical-component box suspended from the electrical-component box, as viewed from the lower side of the casing in the air conditioner according to the first embodiment of the present invention.

FIG. 2 is a perspective view of a casing 21 of the indoor device 2 with a lid of an electrical-component box 25 closed, as viewed from the lower side of the casing 21 in the air conditioner 100 according to the first embodiment of the present invention. FIG. 3 is a perspective view of the casing 21 of the indoor device 2 with the lid of the electrical-component box 25 suspended from this electrical-component box 25, as viewed from the lower side of the casing 21 in the air conditioner 100 according to the first embodiment of the present invention. FIGS. 2 and 3 illustrate a state in which a cosmetic panel that covers the bottom surface of the casing 21 has been removed in the air conditioner 100.

The indoor device 2 includes the casing 21 formed by bending a sheet material into a cuboid shape, and the cosmetic panel (not illustrated) attached to the lower surface of the casing 21. In FIG. 1, the indoor device 2 is illustrated with its cosmetic panel removed. The lower surface of the casing 21 is opposed to the floor in the room in an installation state of the indoor device 2 in which the indoor device 2 is installed in the ceiling.

The casing 21 is fixed to the ceiling wall with fixing bolts (not illustrated). The casing 21 includes a blower 22 located at the center inside the casing 21 and driven by a fan motor, a bell mouth 23 located at the center inside the casing 21, a plurality of outlet ports 24, the electrical-component box 25 located between the bell mouth 23 and one of the outlet ports 24, and the heat exchanger located so as to cover the blower 22. FIG. 2 omits illustrations of the fan motor and the heat exchanger located in the indoor device 2. The fan motor of the indoor device 2 is supplied with power through a power-supply line 6.

In the air conditioner 100 illustrated in FIG. 1, a refrigeration cycle is constituted of the heat exchanger of the indoor device 2, the compressor of the outdoor device 1, and the heat exchanger of the outdoor device 1. During the normal operation of the air conditioner 100, airflow generated by the rotation of the blower 22 passes through the heat exchanger of the indoor device 2, and is then turned to cool air or warm air. The cool air or the warm air is discharged from the outlet ports 24 to cool or heat the room. During the cooling operation or the drying operation, the heat exchanger of the indoor device 2 functions as an evaporator. During the heating operation, the heat exchanger of the indoor device 2 functions as a condenser.

The electrical-component box 25 is constituted of an electrical-component box body 30 that is a box body made of metal sheet and having an elongated cuboid shape, and a lid 40 made of metal sheet and having an elongated rectangular plate-like shape. The electrical-component box body 30 is fixed to the lower surface of the casing 21. The lid 40 serves as the bottom surface of the electrical-component box 25 in the installation state, in which the lid 40 is capable of covering and thus closing an opening 30*h* formed in the electrical-component box body 30. The opening 30*h* is described later.

Figure 4:
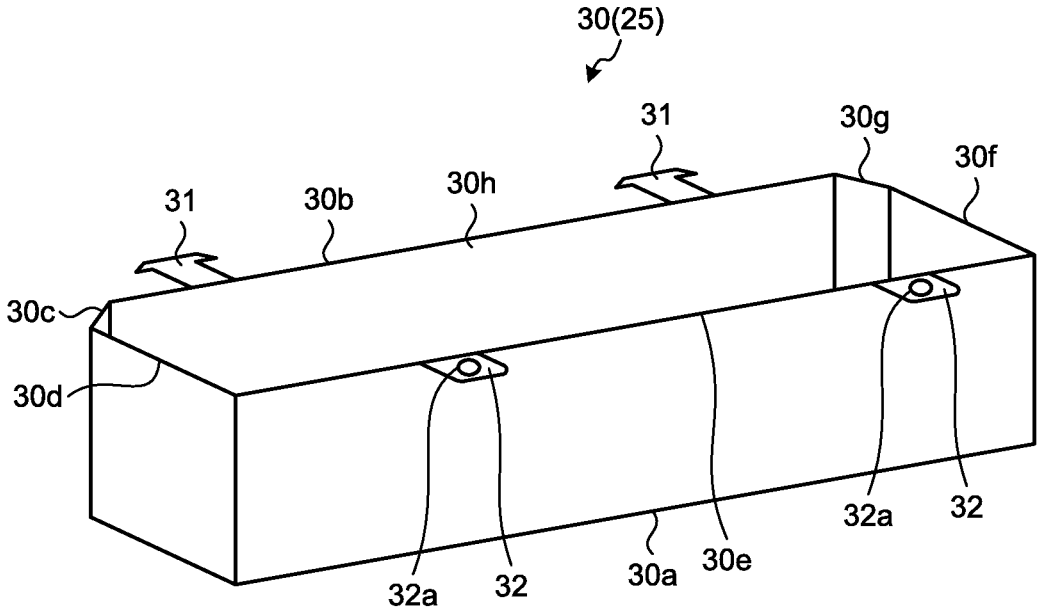
FIG. 4 is a perspective view illustrating a shape of an electrical-component box body of the electrical-component box according to the first embodiment of the present invention.

FIG. 4 is a perspective view illustrating a shape of the electrical-component box body 30 of the electrical-component box 25 according to the first embodiment of the present invention. FIG. 4 illustrates the electrical-component box body 30 which is turned upside down compared to the state in which the electrical-component box 25 is fixed to the lower surface of the casing 21. The electrical-component box body 30 is configured by including a top plate 30*a* that constitutes the top portion of the electrical-component box body 30 in the installation state, and that has an elongated substantially-rectangular shape, and side plates 30*b*, 30*c*, 30*d*, 30*e*, 30*f*, and 30*g* that are the side surfaces extending from the edges of the top plate 30*a*. At the bottom position of the electrical-component box 25 in the installation state, the opening 30*h* is formed opposed to the top plate 30*a*. The edges of the opening 30*h* are defined by the respective lower end portions of the side plates 30*b*, 30*c*, 30*d*, 30*e*, 30*f*, and 30*g*. That is, the electrical-component box body 30 has a box shape with its bottom surface opened in the installation state of the indoor device 2 in which the indoor device 2 is installed in the ceiling.

On the side plate 30*b* which is a side plate extending from the longer-side edge of the top plate 30*a*, two body-side engaging tabs 31 that are the body-side engaging portions are provided in a state of extending outward from the electrical-component box body 30 and parallel to the top plate 30*a*. The body-side engaging tabs 31 are formed integrally with the side plate 30*b* by means of sheet-metal processing. That is, the body-side engaging tabs 31 are provided in a state of protruding outward from the side surface of the electrical-component box body 30. The body-side engaging tabs 31 are the body-side engaging portions used for attaching the lid 40 to the electrical-component box body 30. Each of the body-side engaging tabs 31 also functions as the body-side engaging portion that engages with a lid-side engaging hole 43 in a removable manner in order to suspend the lid 40 from the electrical-component box body 30. The lid-side engaging hole 43 is described later.

On the side plate 30*e* which is a side plate extending from the longer-side edge of the top plate 30*a*, two body-side screwing tabs 32 are provided in a state of extending outward from the electrical-component box body 30 and parallel to the top plate 30*a*. The body-side screwing tabs 32 are formed integrally with the side plate 30*e* by means of sheet-metal processing. A through hole 32*a* used for screwing with a screw 51 is provided at the central portion of the body-side screwing tab 32 having a rectangular shape in plan view. The screw 51 is described later.

Inside the electrical-component box body 30, electrical components (not illustrated) are accommodated, such as various types of actuators and sensors used for controlling the air conditioner 100, and an electrical circuit board connected to the wired remote controller 4.

Figure 5:
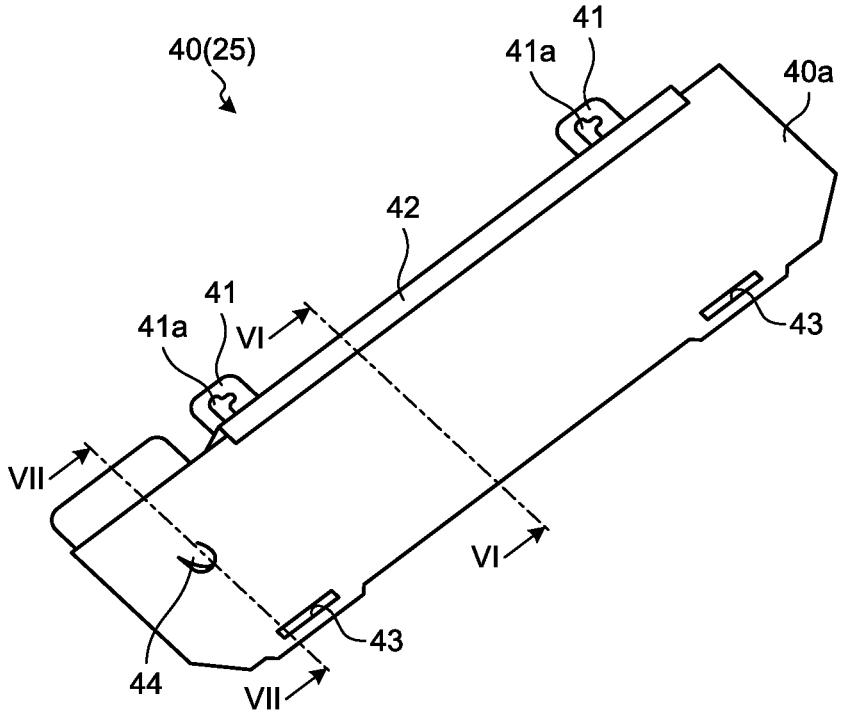
FIG. 5 is a perspective view illustrating a shape of the lid of the electrical-component box according to the first embodiment of the present invention.
Figure 6:
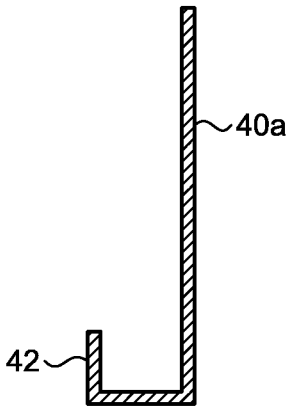
FIG. 6 is a cross-sectional view of the lid of the electrical-component box according to the first embodiment of the present invention, which is taken along the VI-VI line.
Figure 7:
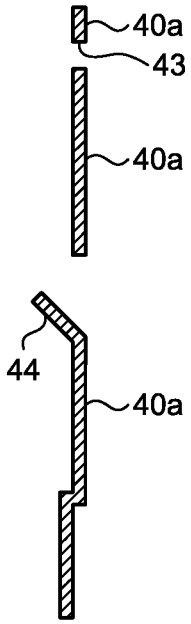
FIG. 7 is a cross-sectional view of the lid of the electrical-component box according to the first embodiment of the present invention, which is taken along the VII-VII line.

FIG. 5 is a perspective view illustrating the shape of the lid 40 of the electrical-component box 25 according to the first embodiment of the present invention. FIG. 6 is a cross-sectional view of the lid 40 of the electrical-component box 25 according to the first embodiment of the present invention, which is taken along the VI-VI line in FIG. 5. FIG. 7 is a cross-sectional view of the lid 40 of the electrical-component box 25 according to the first embodiment of the present invention, which is taken along the VII-VII line in FIG. 5. The lid 40 is configured by including a plate-like flat portion 40*a* having a rectangular shape in plan view, lid-side screwing tabs 41, a bent edge portion 42, the lid-side engaging holes 43, and a cut and raised portion 44.

The lid-side screwing tabs 41 are provided on one of the longer sides of the flat portion 40*a* in a state of extending outward from the flat portion 40*a*. The lid-side screwing tabs 41 are welded integrally with the flat portion 40*a*. A through hole 41*a* that is a keyhole used for screwing with the screw 51 is provided by means of stamping at the central portion of the lid-side screwing tab 41 having a rectangular shape in plan view. The screw 51 is described later.

The bent edge portion 42 is formed by bending one of the longer-side edges of the flat portion 40*a* into an L-shape in cross section. That is, the bent edge portion 42 is formed by bending one of the longer-side edges of the flat portion 40*a* at a right angle toward the interior side of the electrical-component box body 30 with respect to the flat portion 40*a*, and thereafter bending the distal-end part of the bent part at a right angle toward the inner side of the flat portion 40*a*. Therefore, the bent edge portion 42 is formed by a total of 180-degree bend from the flat portion 40*a*. In this manner, one of the longer-side edges of the flat portion 40*a*, and the bent edge portion 42 form a U-shape in cross section. The bent edge portion 42 is located at the lower end portion of the lid 40 in a suspended state in which the lid 40 is suspended from the electrical-component box body 30 as described later. It is thus possible to use the bent edge portion 42 as a temporary item-placement portion on which necessary items for maintenance work including screws and other components can be temporarily placed at a location close to the worker. The bent edge portion 42 includes a surface extending perpendicularly to the flat portion 40*a*, on which items are placed. The bent edge portion 42 also includes a surface extending parallel to the flat portion 40*a*, which prevents the items from dropping.

The interior side of the electrical-component box body 30 refers to the side where the top plate 30*a* of the electrical-component box body 30 is located when the lid 40 is attached thereto. That is, the bent edge portion 42 is provided on one surface of the flat portion 40*a*, which faces the interior side of the electrical-component box body 30 when the lid 40 is attached thereto as described later. The bent edge portion 42 is bent upward in the vertical direction in a state in which the lid 40 is suspended from the electrical-component box body 30 as described later. That is, the distal-end portion of the bent edge portion 42 is directed upward in the vertical direction in a state in which the lid 40 is suspended from the electrical-component box body 30 as described later.

The lid-side engaging holes 43 are the lid-side engaging portions used for attaching the lid 40 to the electrical-component box body 30, and are formed by stamping in an area of the other longer-side edge of the flat portion 40*a*. The lid-side engaging holes 43 are formed with such a shape as to be engageable with the body-side engaging tabs 31 of the electrical-component box body 30. The lid-side engaging holes 43 engage respectively with the body-side engaging tabs 31 in a removable manner. Each of the lid-side engaging holes 43 also functions as the lid-side engaging portion that engages with the body-side engaging tab 31 in a removable manner when the lid 40 is suspended from the electrical-component box body 30.

The cut and raised portion 44 is a protruding portion that protrudes obliquely upward from the flat portion 40*a* in a suspended state in which the lid 40 is suspended from the electrical-component box body 30. The area of the flat portion 40*a* on one-end side in the longitudinal direction is partially cut and raised, such that the cut and raised portion 44 protrudes from the flat portion 40*a*. When the lid 40 is attached to the electrical-component box body 30 as described later, the cut and raised portion 44 is provided on one surface of the flat portion 40*a*, which faces the interior side of the electrical-component box body 30. Therefore, the cut and raised portion 44 protrudes from a surface of the flat portion 40*a* on which the bent edge portion 42 is provided. The raised end portion of the cut and raised portion 44, which is raised from the flat portion 40*a*, is directed obliquely upward in a suspended state in which the lid 40 is suspended from the electrical-component box body 30 as described later. This makes it possible to use the cut and raised portion 44 as a temporary item-placement portion on which necessary items for maintenance work such as a bag, or cables and the like can be hooked and temporarily placed.

Figure 8:
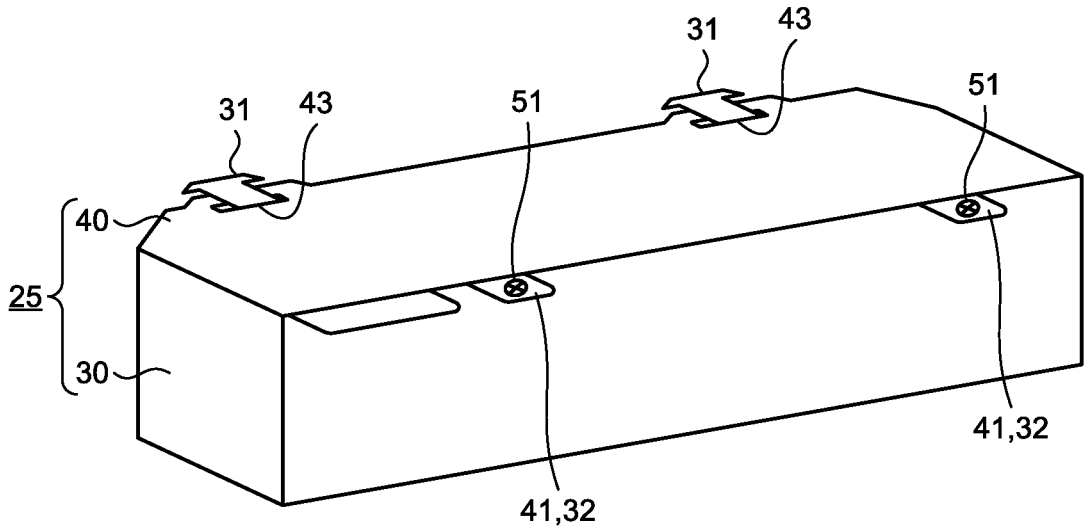
FIG. 8 is a perspective view illustrating a state in which the electrical-component box body according to the first embodiment is closed with the lid.

FIG. 8 is a perspective view illustrating a state in which the electrical-component box body 30 according to the first embodiment of the present invention is closed with the lid 40. When the air conditioner 100 is used, the opening 30*h* of the electrical-component box body 30 is closed with the lid 40 as illustrated in FIGS. 2 and 8 from the viewpoint of prevention of the spread of fire, and noise countermeasures. The lid 40 is fixed to the electrical-component box body 30 by inserting the body-side engaging tabs 31 of the electrical-component box body 30 through the lid-side engaging holes 43 of the lid 40 to be engaged with each other, and fastening the body-side screwing tabs 32 of the electrical-component box body 30, and the lid-side screwing tabs 41 of the lid 40 with the screws 51 inserted through the through holes 32*a* on the body-side screwing tabs 32, and the through holes 41*a* on the lid-side screwing tabs 41.

Figure 9:
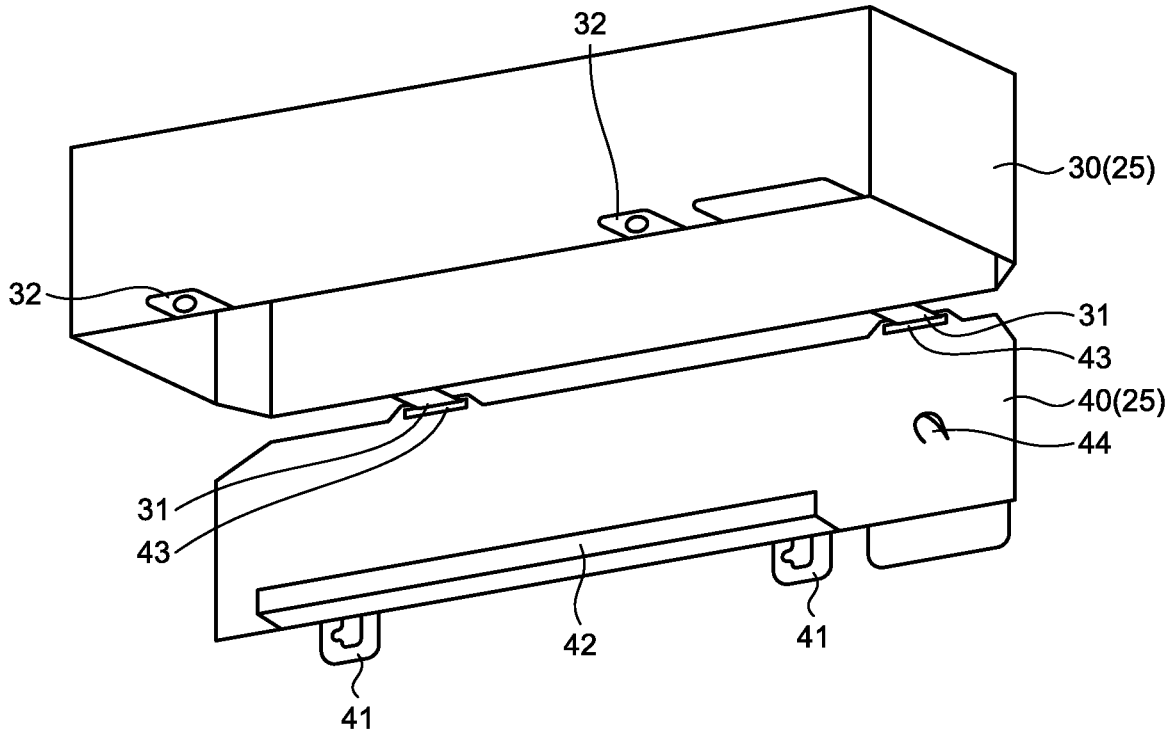
FIG. 9 is a perspective view illustrating a state in which the lid is suspended from the electrical-component box body according to the first embodiment of the present invention.

FIG. 9 is a perspective view illustrating a state in which the lid 40 is suspended from the electrical-component box body 30 according to the first embodiment of the present invention. In an installation state in which the indoor device 2 is installed in the ceiling, the side surfaces of the electrical-component box body 30 that are the side plates 30*b*, 30*c*, 30*d*, 30*e*, 30*f*, and 30*g* are oriented parallel to the vertical direction. The body-side engaging tabs 31 of the electrical-component box body 30 are oriented parallel to the horizontal direction. In a state in which the lid-side screwing tabs 41 are directed downward in the vertical direction, while the flat portion 40*a* is oriented parallel to the vertical direction, the body-side engaging tabs 31 of the electrical-component box body 30 are inserted through the lid-side engaging holes 43 of the lid 40 to be engaged with each other. In this manner, the lid 40 can be suspended from the electrical-component box body 30 as illustrated in FIGS. 3 and 9.

Next, a case of performing maintenance on electrical components is described, which are accommodated in the electrical-component box 25 configured as described above and provided in the indoor device 2 installed in the ceiling. First, a worker stands on the stepladder and removes the cosmetic panel from the indoor device 2. Next, in the exposed electrical-component box 25, the screws 51 that fix the lid 40 to the electrical-component box body 30 are removed. The body-side engaging tabs 31 of the electrical-component box body 30 are disengaged from the lid-side engaging holes 43 of the lid 40 to remove the lid 40 from the electrical-component box body 30.

Subsequently, the body-side engaging tabs 31 of the electrical-component box body 30 are respectively inserted through the lid-side engaging holes 43 of the lid 40 to be engaged with each other. At this time, the body-side screwing tabs 32 of the electrical-component box body 30, and the lid-side screwing tabs 41 of the lid 40 are not screwed with each other. In this manner, the lid 40 can be suspended from the electrical-component box body 30 as illustrated in FIGS. 2 and 9. In this state, the worker performs maintenance work on the electrical components.

The lid 40 is suspended from the electrical-component box body 30 as illustrated in FIG. 9, and thus one of the longer-side edges of the flat portion 40*a*, and the bent edge portion 42 form a U-shape in cross section with its upper part opened at the lower end portion of the lid 40. Therefore, in the indoor device 2, it is possible to temporarily place the removed screws 51 on the bent edge portion 42.

In a case where a worker performs maintenance work with the screws 51 temporarily placed on the bent edge portion 42, the worker can use his hands more freely as compared to the case where the worker performs maintenance work with the screws 51 held in his hand. This facilitates the maintenance work and thus improves the work efficiency.

Further, in the case where a worker performs maintenance work with the screws 51 temporarily placed on the bent edge portion 42, the worker can reduce the number of times of stepping on/off the stepladder as compared to the case where the worker performs maintenance work with the screws 51 temporarily placed on the floor or somewhere else. This facilitates the maintenance work and thus improves the work efficiency.

In a case where the screws 51 are temporarily placed on the top of the stepladder, a worker needs to change his posture on the stepladder to pick up the screws 51 and there is a possibility for the worker to step on the screws 51 and lose his balance. In contrast to this case, in the case where a worker performs maintenance work with the screws 51 temporarily placed on the bent edge portion 42, the worker can pick up the screws 51 without changing his posture on the stepladder, and does not step on the screws 51 and does not lose his balance. This facilitates the maintenance work and thus improves the work efficiency.

A worker performs maintenance work on the electrical components on a stepladder, including on-off switching and attachment of the cables and the like.

The lid 40 is suspended from the electrical-component box body 30 as illustrated in FIG. 9. This makes it possible to temporarily hook work tools or components such as a bag, or cables and the like on the cut and raised portion 44. Due to this structure, a worker can perform maintenance work with the cables and the like kept within his sight, and therefore does not need to look for the cables and the like when necessary. This improves the work efficiency. By hooking a bag with smaller items such as replacement components stored therein on the cut and raised portion 44, a worker can proceed with maintenance work without the need to step on/off the stepladder frequently to pick up the replacement components. This facilitates the maintenance work and thus improves the work efficiency.

Therefore, use of the electrical-component box 25 according to the present embodiment facilitates maintenance work on the electrical components accommodated in the electrical-component box 25. This improves the work efficiency.

In the above descriptions, the case has been explained, in which when the lid 40 is suspended from the electrical-component box body 30 as illustrated in FIG. 9, one of the longer-side edges of the flat portion 40*a*, and the bent edge portion 42 form a U-shape in cross section with its upper part opened at the lower end portion of the lid 40. However, as long as components can be temporarily placed on the bent edge portion 42, it is allowable that the total bending angles for forming the bent edge portion 42 are smaller than 180 degrees.

It is also possible to provide a cross-sectional L-shaped portion that is similar to the bent edge portion 42 on one surface of the flat portion 40*a*, which faces the interior side of the electrical-component box body 30, or on the other surface of the flat portion 40*a*, which faces the exterior side of the electrical-component box body 30, such that the L-shaped portion can be used as a temporary item-placement portion. However, the bent edge portion 42 is more preferable because it is usually accommodated inside the electrical-component box body 30, and thus does not come into contact with members outside the electrical-component box 25.

It is permissible that the cut and raised portion 44 protrudes from the flat portion 40*a* toward the exterior side of the electrical-component box body 30. However, the cut and raised portion 44 is more preferable because it is usually accommodated inside the electrical-component box body 30, and thus does not come into contact with members outside the electrical-component box 25.

In the above descriptions, the ceiling-mounted air conditioner 100 has been explained. When the electrical-component box 25 described above is applied to a ceiling-suspended air conditioner, maintenance-work efficiency can be also improved similarly to the ceiling-mounted air conditioner 100 described above. Therefore, in an air conditioner with an indoor device installed on the ceiling, the electrical-component box 25 is installed on the lower surface of the indoor device, and thereby the air conditioner can also obtain the effects described above.

As explained above, in the air conditioner 100 according to the first embodiment, at the time of performing maintenance on the electrical components in the electrical-component box 25, smaller items such as the screws 51 can be temporarily placed on the bent edge portion 42 provided at the lower end portion of the lid 40 in a suspended state in which the lid 40 is suspended from the electrical-component box body 30. Due to this structure in the air conditioner 100, a worker does not need to significantly change his posture during maintenance work. This facilitates the maintenance work and can improve the work efficiency.

In the air conditioner 100, at the time of performing maintenance on the electrical components in the electrical-component box 25, work tools or components such as a bag, or cables and the like can be temporarily placed on the cut and raised portion 44 of the flat portion 40*a* of the lid 40 in a suspended state in which the lid 40 is suspended from the electrical-component box body 30. Due to this structure in the air conditioner 100, smaller items such as replacement components can be stored in a bag hooked on the cut and raised portion 44, and a worker can pick up the replacement components without the need to step on/off the stepladder. This facilitates the maintenance work and improves the work efficiency. Further, the worker can perform maintenance work with cables and the like kept within his sight, and therefore does not need to look for the cables and the like when necessary. This facilitates the maintenance work and improves the work efficiency.

Accordingly, the air conditioner 100 according to the first embodiment has an effect where it is possible to facilitate maintenance on electrical components in the electrical-component box 25.

The configurations described in the above embodiments are only examples of the content of the present invention. The configurations can be combined with other well-known techniques, and a part of each configuration can be omitted or modified without departing from the scope of the present invention.

The invention claimed is:

1. An air conditioner comprising an electrical-component box to accommodate therein electrical components on a lower surface of the air conditioner in an installation state in which the air conditioner is installed in a ceiling, wherein the electrical-component box includes an electrical-component box body having a box shape with a lower surface opened in the installation state, and including a body-side engaging portion protruding outward from a side surface, and a plate-like lid including a flat portion capable of closing the opening and including a lid-side engaging portion to be engaged with the body-side engaging portion, the lid is capable of being suspended from the electrical-component box body by engaging the lid-side engaging portion with the body-side engaging portion, and the lid includes a temporary item-placement portion on which items can be temporarily placed in a suspended state in which the lid is suspended from the electrical-component box body;

wherein the temporary item-placement portion is a bent edge portion formed in such a manner that the lower end portion of the lid is bent at a 180-degree angle from the flat portion in the suspended state, the bent edge portion including a surface extending perpendicularly to the flat portion, on which items are placed, together with a surface extending parallel to the flat portion, which prevents the items from dropping, and wherein the bent edge portion is accommodated inside of the electrical-component box body when the lid is in a closed state.

2. The air conditioner according to claim 1, wherein a protruding portion is formed on the flat portion of the lid, the protruding portion protruding obliquely upward from the flat portion of the lid in the suspended state, on which items can be temporarily placed.

3. The air conditioner according to claim 2, wherein the protruding portion is a cut and raised portion formed by cutting and raising the flat portion of the lid in the suspended state.

* * * * *